US009549451B2

(12) United States Patent
Saes et al.

(10) Patent No.: US 9,549,451 B2
(45) Date of Patent: Jan. 17, 2017

(54) METHOD FOR OPERATING A LIGHTING GRID AND LIGHTING UNIT FOR USE IN A LIGHTING GRID

(75) Inventors: Marc Saes, Eindhoven (NL); Hubert Johan Marie Robert Van Doorne, Waalre (NL)

(73) Assignee: ELDOLAB HOLDING B.V., Son en Breugel (NL)

( * ) Notice: Subject to any disclaimer, the term of this patent is extended or adjusted under 35 U.S.C. 154(b) by 757 days.

(21) Appl. No.: 13/504,262

(22) PCT Filed: Oct. 26, 2010

(86) PCT No.: PCT/NL2010/050713

§ 371 (c)(1),
(2), (4) Date: Apr. 26, 2012

(87) PCT Pub. No.: WO2011/053132

PCT Pub. Date: May 5, 2011

(65) Prior Publication Data

US 2012/0212156 A1 Aug. 23, 2012

Related U.S. Application Data

(60) Provisional application No. 61/254,802, filed on Oct. 26, 2009.

(51) Int. Cl.
*H05B 37/02* (2006.01)

(52) U.S. Cl.
CPC ..... *H05B 37/0245* (2013.01); *H05B 37/0227* (2013.01)

(58) Field of Classification Search
CPC . H05B 37/02; H05B 37/0263; H05B 37/0272; H05B 37/0227; H05B 37/034; H05B 33/0803; Y02B 20/72; Y02B 20/44; Y02B 20/46; Y02B 20/48
(Continued)

(56) References Cited

U.S. PATENT DOCUMENTS 8,907,572 B2 * 12/2014 So ..... H05B 37/0263 315/160
9,288,878 B2 * 3/2016 Dillen ..... H05B 37/0227
(Continued)

FOREIGN PATENT DOCUMENTS

EP 1091334 A1 4/2001
EP 1871145 A1 12/2007
(Continued)

*Primary Examiner* — Haissa Philogene
(74) *Attorney, Agent, or Firm* — Browdy and Neimark, P.L.L.C.

(57) ABSTRACT

A method of operating a lighting grid having lighting units the method including receiving an input signal from a sensor or a user interface by a first lighting unit, determining a control signal for controlling an LED driver and/or LED assembly of the first lighting unit based on the input signal, transmitting an output signal to a second lighting unit, the output signal being based on the input signal and enabling an identification of the first lighting unit, the sensor or the user interface, receiving the transmitted output signal from the first lighting unit by the second lighting unit, establishing an identification, based upon the received output signal, of the first lighting unit, the sensor or the user interface, and determining a further control signal for controlling an LED driver and/or LED assembly of the second lighting unit based on the output signal and the identification.

19 Claims, 5 Drawing Sheets

Figure 1:
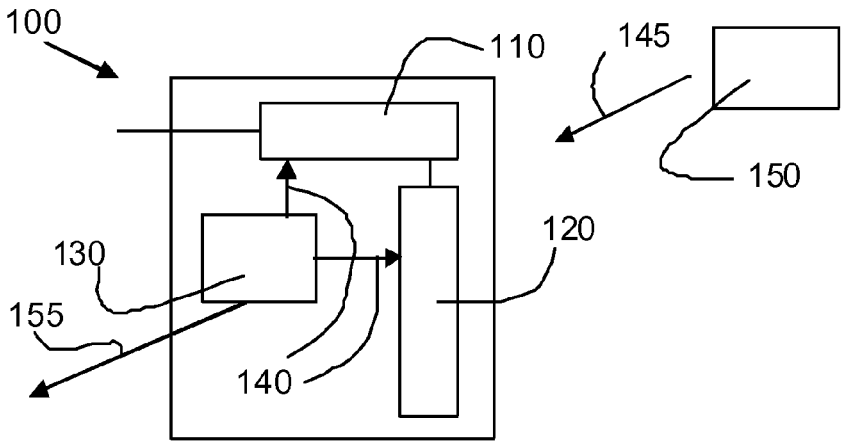

(58) Field of Classification Search
USPC ..... 315/312, 149, 158, 294, 297, 307, 362
See application file for complete search history.

(56) References Cited

U.S. PATENT DOCUMENTS

| | | | | |
|---|---|---|---|---|
| 2006/0125426 | A1 | 6/2006 | Veskovic et al. | |
| 2006/0202851 | A1 | 9/2006 | Cash et al. | |
| 2007/0149215 | A1* | 6/2007 | Misikangas | 455/456.1 |
| 2008/0297070 | A1 | 12/2008 | Kuenzler et al. | |
| 2008/0298330 | A1* | 12/2008 | Leitch | 370/338 |

FOREIGN PATENT DOCUMENTS

| | | | | |
|---|---|---|---|---|
| FR | 2906098 | A1 | 3/2008 | |
| WO | 03098977 | A1 | 11/2003 | |
| WO | 2008052293 | A1 | 5/2008 | |
| WO | 2009003279 | * | 1/2009 | H05B 37/02 |

* cited by examiner

METHOD FOR OPERATING A LIGHTING GRID AND LIGHTING UNIT FOR USE IN A LIGHTING GRID

BACKGROUND

The present invention relates to a lighting grid of e.g. a corridor or a parking requiring an appropriate illumination level in a comparatively large area or part of a comparatively large area. In general, such a lighting grid comprises a plurality of light sources and is arranged to adjust the illumination as provided by the different light sources based upon input data received from one or more sensors or user interfaces of the lighting grid.

In general, such a lighting grid comprises a central control unit arranged to receive input from the one or more sensors of the lighting application and control the plurality of light sources according to the received input. Examples of such sensors are e.g. proximity sensors or motion sensors.

In order to ensure proper operation of the lighting grid (i.e. providing the required illumination given the input e.g. received from the one or more sensors or user interfaces, extensive and complex programming of the central control unit may be required. Configuring a lighting grid in such manner may thus be an expensive and time-consuming process which may require highly trained personnel. As a consequence, adjusting the lighting grid, e.g. expanding the area to be illuminated or incorporating additional light sources or replacing light sources may require reprogramming or additional programming of the central control unit.

In view of the above, it is an object of the present invention to provide a method of operating a lighting grid, a lighting grid and a lighting unit for use in a lighting grid that, at least partly, alleviates one or more of the drawbacks mentioned.

SUMMARY OF THE INVENTION

According to an aspect of the present invention, there is provided a method of operating a lighting grid comprising a plurality of lighting units, the method comprising the steps of:

- receiving an input signal from a sensor or a user interface by a first lighting unit of the lighting grid;
- determining a control signal for controlling an LED driver and/or LED assembly of the first lighting unit in response to the input signal;
- transmitting, in response to the input signal, an output signal to a second lighting unit of the lighting grid, the output signal enabling an identification of the first lighting unit;
- receiving the transmitted output signal from the first lighting unit by the second lighting unit;
- establishing an identification, based upon the received output signal, of the first lighting unit;
- determining a further control signal for controlling an LED driver and/or LED assembly of the second lighting unit based on the identification.

The method of operating a lighting grid according to the present invention enables the control of a lighting grid by communicating comparatively compact signals between the lighting units forming the lighting grid. In accordance with the present invention, a lighting unit comprises an LED assembly, an LED driver for powering the LED assembly and a control unit for controlling the LED driver and/or the LED assembly. Further details on such a lighting unit are provided below.

In accordance with the invention, a lighting grid is a system comprising a plurality of lighting units which can co-operate (e.g. by way of communicating control signals between the lighting units) to realize a desired lighting effect. In the method according to the invention, a first lighting unit is arranged to, upon receipt of an input signal from a sensor or a user interface, transmit an output signal to a second lighting unit of the lighting grid, the output signal enabling an identification of the first lighting unit. In addition to enabling the identification of the first lighting unit, the output signal can e.g. further comprise a set point describing a desired illumination parameter such as a brightness or color. In accordance with the invention, rather than transmitting with the output signal an identifier of the lighting unit or units that should respond to the output signal, the output signal enables the identification of the lighting unit that provided the signal, i.e. the first lighting unit. An identification of the lighting unit that provided the output signal can, within the meaning of the present invention, also correspond to an identification of the event or event-source that caused the lighting unit to provide the output signal. This event or event-source can e.g. be a sensor detecting an environmental change and in response providing a signal to the lighting unit or a user action on a user interface providing a signal to the lighting unit.

In order to enable the identification of the lighting unit that provided the signal, different methods can be applied as explained in more detail below. Upon receipt of the signal from the first lighting unit, the second lighting unit can establish the identification of the lighting unit that provided the signal (i.e. the first lighting unit) and determine a further control signal for controlling an LED driver and/or LED assembly of the second lighting unit based on the identification. As an example, upon identification of the lighting unit that provided the signal, the second lighting unit can be controlled in a predetermined manner, based upon the identification. The control unit can e.g. comprise a table (e.g. stored in a memory unit of the control unit) indicating how to respond (i.e. control the lighting unit) upon receipt of an output signal from a certain other lighting unit. As such, it may be sufficient for a lighting unit to transmit (e.g. via a wired or wireless communication output of the control unit of the lighting unit), in response to an input signal, an output signal solely comprising an identifier of the transmitting lighting unit. The identification of the transmitting lighting unit, combined with information available to the second lighting unit (e.g. in a memory unit or database accessible by the unit) can be sufficient to control the second lighting unit to obtain a desired lighting effect.

According to another aspect of the invention, there is provided a first type of lighting unit for use in a lighting grid, the lighting unit comprising

- an LED assembly comprising one or more LEDs;
- an LED driver, electrically connected to the LED assembly for providing power to the LED assembly;
- a control unit comprising:
  - an input for receiving an input signal from a sensor or a user interface;
  - a control output for providing a control signal to the LED driver and/or the LED assembly for controlling the LED driver and/or the LED assembly, the control signal being based on the input signal;
  - a communication output for transmitting, in response to the input signal, an output signal to one or more further lighting units, the output signal enabling an identification of the lighting unit;.

A lighting unit according to the present invention which can be applied in a lighting grid according to the invention comprises an LED driver and an LED assembly. In accordance with the present invention the term LED driver is used to designate a power supply unit for providing power to an LED assembly. As an example, an LED driver can e.g. be a current source such as a Buck converter or a Boost converter or the like. In accordance with the present invention, an LED assembly comprises one or more light emitting diodes (LEDs) which can be powered by the LED driver. As an example, an LED assembly can comprise a first group of one or more RED LEDs, a second group of one or more GREEN LEDs, and a third group of one or more BLUE LEDs whereby each group can be powered separately by the LED driver, e.g. with a different duty cycle to generate a required colour output. The lighting unit according to the invention further comprises a control unit for either controlling the LED driver, the LED assembly or both, e.g. by providing a control signal to either the LED driver or the LED assembly via a control output or output terminal of the control unit. As an example, the control unit can control the LED driver to provide a current to the LED assembly thereby powering the one or more LEDs of the LED assembly. Alternatively or in addition, the control unit can e.g. be arranged to control one or more switches of the LED assembly, the switches e.g. being arranged to energize or de-energize the one or more LEDs of the LED assembly.

In accordance with the present invention, a lighting grid is a system comprising a plurality of lighting units that are enabled to co-operate to establish a desired lighting effect. A desired lighting effect can e.g. be established when one of the lighting units of the lighting grid is provided with an input signal, e.g. from a sensor or user interface whereupon the lighting unit provides an output signal (e.g. by wireless communication) to the other lighting units of the lighting grid to realize the desired lighting effect. The input signal originating from a sensor or user interface can e.g. be provided at an input or input terminal of the control unit whereas the output signal can be provided via any suitable communication output (either wired or wireless) of the control unit to one or more other lighting units of the lighting grid. In order to realize the desired lighting effect, it may be required that only a subset of the other lighting units receiving the output signal, respond to the signal. In order to ensure that only the appropriate lighting units respond, it is common to apply an identifier or identifiers identifying the lighting units that need to respond to the signal. A control unit receiving the identifier may then, when an identifier corresponds to its own ID or identifier, determine whether and how to respond to the signal. As will be acknowledged by the skilled person, such an approach may result in a large amount of data that needs to be communicated between the lighting units.

Known lighting units (e.g. lighting units comprising an LED assembly, a LED driver for powering the LED assembly and a control unit for controlling the LED driver and/or LED assembly) that are applied in lighting applications are arranged to receive an input signal e.g. from a sensor (e.g. a proximity or motion sensor) or a user interface such as a switch. Upon receipt of the input signal (e.g. via an input terminal of the control unit of the LED assembly), the control unit may generate a control signal to control either the LED driver or the LED assembly (or both) to provide a required response to the input signal.

In case the receipt of an input signal (the input signal representing the occurrence of an event) requires a coordinated operation of different lighting units (e.g. to obtain a desired lighting effect), a central control unit is often applied, the central control unit receiving the input signal and converting the input signal to a control signal for the lighting units that need to respond to the input signal. Such an arrangement, wherein the intelligence of the lighting application is present in a centralized unit, e.g. a central control unit, may require extensive and complex programming for providing the appropriate response to the input signal for all lighting units.

Rather than requiring a centralized control unit, in accordance with the invention, the control unit of the lightning unit is arranged to receive an input signal (e.g. from a sensor or a user interface), determine a control signal from the input signal for controlling the lighting unit and determine an output signal for transmission to one or more further lighting units, the output signal enabling an identification of the lighting unit and subsequently transmit the output signal to the one or more further lighting units.

In accordance with the invention, the control unit of the lighting unit is arranged to transmit an output signal to one or more further lighting units, the transmitted signal being characterized in such way that a control unit of a further lighting unit receiving the transmitted signal can identify the origin of the signal, i.e. the lighting unit that transmitted the signal.

In an embodiment, the control unit of the lighting unit is further arranged to

- receive a transmitted output signal from one or more further lighting units;
- establish an identification, based upon the received transmitted signal, of the one or more further lighting units that provided the transmitted signal;
- determine a further control signal for controlling the LED driver or LED assembly based on the output signal and the identification.

In an embodiment, the transmitted output signal is broadcasted such that all further lighting units of the lighting grid can receive the signal.

In an embodiment, the transmitted output signal may further comprise a signal representing a set point (e.g. describing a desired illumination parameter such as a brightness or color) for the one or more further lighting units.

In an embodiment, a control unit can, upon receipt of the transmitted output signal, determine a further output signal and transmit the further output signal.

Characterizing the output signal that is transmitted in such way that its origin can be identified, can be established in different ways:

As a first example, in an embodiment, the transmitted output signal provided by a control unit of a lighting unit to a control unit of a further lighting unit can e.g. comprise an identification or identifier of the control unit that provided the signal. Based upon the output signal and the identification the control unit of the lighting unit can thus determine whether or not to respond and how to respond to the output signal and, if required, determine a control signal for controlling the lighting unit, i.e. the LED assembly and/or the LED driver of the lighting unit. It is worth noting that such an identifier or identification is merely intended to allow a control unit receiving the signal to assess how to respond to the received signal.

As a second example, in an embodiment, an identification of the control unit or lighting unit that transmitted the output signal can be based on a signal strength of the received output signal. When the transmitted output signal is transmitted with a predetermined signal strength, the signal strength of the received signal will, in general, be smaller.

Based upon the signal strength of the received signal, a control unit can thus determine or approximate the origin of the transmitted signal. This may enable the control unit to determine/identify the control unit or lighting unit that provided, i.e. transmitted the output signal. From the strength of the received signal, a control signal can subsequently be derived for controlling the LED assembly or LED driver. The derivation of the control signal may thus hold the determination of intermediate results such as a distance approximation. The strength of the signal can be derived in may ways, including e.g. counting a number of hops the sending lighting unit is distanced from the receiving lighting unit, as well as more traditional amplitude measurements.

In an embodiment, the present invention provides a lighting grid comprising a plurality of lighting units according to the invention.

In accordance with the present invention, the lighting grid or a part thereof, can be configured prior to normal operation, by operating the lighting grid or part thereof in a configuration mode, as explained in more detail below. During such configuration mode, the lighting units operating in such mode can e.g. be provided with instructions on how to respond to a signal or signals received, either signals from sensors, user interfaces or other units. Equally, in accordance with the present invention, configuring a lighting grid or part thereof can be understood as providing information regarding the topology of the grid to the lighting grid or lighting units of the grid. As will be explained in more detail below, such information may also be applied to determine a required response of a lighting unit.

In an embodiment, the configuring of the lighting grid or part thereof can be done by providing the configuration data to a central database accessible by each lighting unit or to each lighting unit separately, or a combination thereof. As an example of the latter, each lighting unit can e.g. be provided with a default configuration (in a centralized manner) while lighting units that require particular configuration data can be addressed individually, e.g. using a mobile configuration device.

In an embodiment, the configuration data, e.g. comprising data on the topology of the lighting grid, can be distributed over the different lighting units of the grid. As an example, each lighting unit can hold, in a local memory unit, part of the configuration data. In such embodiment, communication between the lighting units can be used to enable each lighting unit to have access to all configuration data or information. This can be arranged through direct communication to all lighting units or through indirect communication via a gossip or epidemic communication protocols. A configuration unit connected to only 1 single lighting unit may in this case supply all configuration info to this single lighting unit, further relying on the gossip protocol to have the information distributed to all lighting units. Lighting units may thereby discard information after redistribution that is not locally significant.

In an embodiment, at least part of the configuration data is obtained in an automated manner by operating the lighting grid in a learning mode.

In such a learning mode, which can be part of a configuration operation, information can be gathered by the lighting grid, such information e.g. comprising information on the topology of the grid. As explained in more details below, the process of gathering information when the grid operates in a learning mode can be an automated process, i.e. substantially without the interference of an installer or may be a process that requires some type of user/installer intervention.

In an embodiment, the control units of the lighting units of the lighting grid according to the invention are provided with, or have access to, information regarding the topology or lay-out of the lighting grid. Such information can e.g. include data describing the locations of further lighting units. As such, upon receipt of an output signal, the control unit of a lighting unit can determine, based on the information, a control signal for the lighting unit.

In an embodiment, the database containing information on the topology or lay-out of the lighting grid is provided in a memory unit of lighting units. Rather than providing the same database to each lighting unit, in an embodiment each lighting unit of the lighting grid is only provided with part of the database relevant to it. The lighting units of the lighting grid can further be provided with communication facilities to exchange topology information amongst each other and between them and a configuration device.

Access to such information may e.g. enable a control unit to determine a distance between the control unit that transmitted the output signal and the control unit receiving the signal. A response of the lighting unit comprising the control unit that received the signal can e.g. rely on this information. Making such information available to the control units (e.g. stored in a memory unit of the control unit or accessible via a central database) may also simplify the output signal to be transmitted. To illustrate this, the occurrence of an event may trigger a sensor and require a certain lighting effect within a certain radius of the sensor or a lighting effect depending in strength as a function of the distance to the sensor. In order to achieve this effect, it may be sufficient to output a signal (e.g. by broadcast) comprising an identifier of the control unit transmitting the signal and optionally an indication of the event. Each control unit receiving the signal may then, based upon the identifier and available information regarding the topology of the grid, determine whether or not it is within the radius of the occurring event and thus determine a control signal for the LED assembly and/or LED driver accordingly.

In an embodiment, it may be sufficient to output, by the control unit receiving the signal indicating the occurrence of an event (the signal e.g. originating from a sensor associated with the control unit), an output signal that comprises an ID of the event or the sensor that sensed the occurrence of the event. As such, the output signal can e.g. merely comprise an identifier of the sensor, and/or the sensor signal itself. A control unit of a lighting unit receiving such a signal, can be arranged to establish how to respond to the signal based on a determination of the origin of the signal, e.g. based on the identifier of the sensor or the sensor signal itself.

In a lighting grid comprising a plurality of lighting units, various events can occur, e.g. observed by various sensors in the grid. In order to establish an identification of the control unit transmitting a signal indicating the occurrence of an event, it may thus be sufficient to broadcast, by an output signal, an identifier or ID of the event whereupon each control unit or lighting unit receiving the broadcasted signal can determine, based upon the ID, whether or not and how to respond to the event that occurred.

Within the meaning of the present invention, establishing an identification of a lighting unit that provided an output signal can also be implicit in that the outputted signal provides information regarding the origin of the signal. As such, an identification of the lighting unit providing an output signal can, within the meaning of the present invention, correspond to an identification of the event or event-source that caused the lighting unit to provide the output signal. This event or event-source can e.g. be a sensor detecting an environmental change and in response providing a signal to the lighting unit or a user action on a user interface providing a signal to the lighting unit. Within the meaning of the present invention, the term 'event' is used to i.a. indicate the occurrence of a change in the environment of a lighting unit or lighting grid (e.g. a person entering a room, a change in brightness, a user action on a user interface, etc. . . . ), 'event-source' is i.a. used to indicate a hardware component such as a sensor or user interface capable of detecting an event and providing a signal in response to it.

In an embodiment, the output signal transmitted by the control unit of the lighting unit according to the invention further comprises a group identifier. Such a group identifier may also be applied by a control unit receiving the output signal as a criterion, in addition to the identification of the event transmitted by the control unit or the identification of the control unit that transmitted the signal, to decide how to respond to the output signal received. The application of a group identifier in the output signal may further simplify the signal to be broadcasted in order to realize the desired lighting effect.

When applying such a group identifier or group ID in a transmitted output signal, in addition to applying an identification of an event or the control unit that transmitted the output signal, the lighting units receiving the output signal should be able to assess whether they belong to the group of lighting units associated with the group ID. This information can e.g. be stored in a memory unit of the control unit or can be made available to the lighting units using a central database.

The application of an identification of the control unit transmitting the output signal allows the signal to be broadcasted e.g. to all control units. Based upon the identification, a control unit of a further lighting unit can determine whether or not to respond to the signal, such a response e.g. comprising determining a further control signal for controlling the further lighting unit. The broadcasted signal to the further lighting units therefore does not need to comprise an identifier of the lighting units that should respond to the signal as the lighting units themselves (i.e. the control units of the lighting units) are arranged to determine whether or not and how to respond to the signal.

In an embodiment, the lighting unit according to the invention comprises a sensor for providing the input signal. Examples of such sensors include but are not limited to:

- motion sensors,
- IR sensors,
- vibration sensors,
- audio sensors,
- light or color sensors,
- moisture sensors, . . . .

Such sensors can e.g. be applied to detect the presence of a person at a specific location.

In an embodiment, a sensor is associated with a lighting unit, the lighting unit thus being arranged to receive an input signal of the sensor, the input signal indicating the occurrence of an event, e.g. the presence of a person on a predetermined location. In order to provide the input signal to the lighting unit, a wired connection can e.g. be provided between the sensor and lighting unit. Other communication interfaces between the sensor and the lighting unit are equally possible.

In an embodiment, the sensor is arranged to provide the input signal to a plurality of lighting units, e.g. by a wireless or wired communication interface. Various options exist for such a communication interface. Similarly, the communication between the plurality of lighting units in a lighting grid according to the invention can be established in various ways. Examples of ways of communication between the plurality of lighting units of the lighting grid according to the invention or a sensor and a lighting unit according to the invention or as can be applied in the method according to the invention include but are not limited to:

Communication via a copper cable network using:
- LAN
- DMX
- PLC
- LON
- LEDsync
- etc.

Communication via a wireless network using:
- FR
- Light
- Audio

Communication by means of vibration:
- Via walls
- Via water

In case a sensor signal is communicated to a plurality of lighting units, the control units of the lighting units can be configured to respond to the signal or not. As an example, only a subset of the lighting units of the plurality of lighting units in a lighting grid according to the invention (the subset of lighting units being arranged in a vicinity of the sensor) can be configured to respond to the sensor signal received.

In an embodiment, the lighting grid according to the invention can, as mentioned above, comprise a plurality of lighting units as described above. In such an arrangement, each lighting unit is equipped to receive an input signal from a sensor or a user interface indicative of the occurrence of an event. It is however worth noting that not all lighting units need to be capable of receiving an input signal or transmitting an output signal. In order to obtain a desired lighting effect, it may be sufficient to have a first subset of lighting units of the lighting grid being arranged to receive an input signal from a sensor or a user interface indicative of the occurrence of an event, whereas a second subset of lighting units of the lighting grid is provided with a control unit that is arranged to:

- receive an output signal transmitted by a control unit of the lighting unit;
- establish an identification of the lighting unit that transmitted the output signal, based upon the received output signal; and
- determine a control signal for controlling the LED driver or LED assembly of the lighting unit based on the output signal received and the identification.

As such, the present invention further provides in a second type of lighting unit for use in a lighting grid, the lighting unit comprising

- an LED assembly comprising one or more LEDs;
- an LED driver, electrically connected to the LED assembly for providing power to the LED assembly;
- a control unit comprising:
  - a communication input for receiving a transmitted output signal from one or more further lighting units;
  - a control output for providing a control signal to the LED driver and/or the LED assembly for controlling the LED driver an/or the LED assembly based on the output signal and an identification of the one or more further lighting units;
- the control unit being arranged to establish the identification of the one or more further lighting units, based upon the received output signal.

The lighting grid according to the invention can be configured in various ways. Such configuration can e.g. include determining for each lighting unit how to respond to a signal received from an identifiable, other control unit or from an identification of the event or event-source. Such configuration can e.g. also include grouping a number of lighting units and assigning a group identifier or group ID to a subset of lighting units of the lighting grid. Different ways of configuring the lighting grid are explained in more detail below.

According to yet another aspect of the invention, there is provided a method of configuring a lighting grid comprising a plurality of lighting units, the method comprising the steps of

- providing a signal to the lighting grid to operate the lighting grid in a configuration mode;
- selecting a lighting unit of the lighting grid to be configured;
- establishing a configuration signal for the selected lighting unit;
- providing the configuration signal to the lighting grid; and
- configuring the selected lighting unit by the configuration signal.

Upon installation of a lighting grid, e.g. comprising a plurality of LED based lighting units, a configuration of the lighting units (e.g. enabling the different lighting units to respond in a particular manner when particular situations or events occur) may be required. As an example, such a configuration can comprise instructing the lighting units of a lighting grid according to the invention, how to respond to certain control signals received, e.g. from sensors or other lighting units.

In order to implement the configuration method according to the invention, a configuration tool can be applied. This can facilitate the configuration of a lighting grid in case no central control unit is present in the lighting grid.

In accordance with the present invention, the configuration method comprises the step of providing a signal to the lighting grid thereby enabling the lighting grid to operate in a configuration mode. Such a step can e.g. be implemented by a central control unit (if available) or a configuration tool providing a dedicated signal to the lighting units of the lighting grid (or a subset of the lighting units) thereby enabling the lighting units to receive and process instructions regarding a required configuration. In an embodiment, such a signal can be broadcasted (e.g. using RF communication) to all lighting units of the grid. As an alternative, a mobile pointing device, enabling to provide a signal to selected single lighting unit (e.g. a directional light signal), could be applied to select one or more lighting units that need to operate in a configuration mode. In the latter case, it will be clear that the lighting units that need to be configured, need to be susceptible to the signal. In case the lighting units that need to be configured are provided with a sensor, e.g. a light sensor, providing a particular light signal to the sensor (e.g. having a particular intensity, color, duty cycle, etc. . . . ) can be recognized by the lighting unit as a command to operate in a configuration mode. It will be appreciated by the skilled person that alternative ways of communication (as e.g. described above) can also be applied to provide a signal to the lighting grid thereby enabling the lighting grid to operate in a configuration mode.

Note that, in response to the signal, the lighting units of the lighting grid can be configured to generate a certain light output, thereby providing a visual confirmation of the lighting units operating in the configuration mode.

In a next step of the configuration method according to the invention, a selection is made of the lighting unit or lighting units that are to be configured.

In an embodiment, the selection can be performed by a central control unit (if present in the lighting grid), based on an identifier (ID) of the lighting unit to be selected. As an alternative, a mobile pointing device, as described above, can also be applied to select one or more lighting units that are operating in a configuration mode. This can be done in a similar manner as described above, i.e. by providing a signal, using the pointing device to the lighting unit(s) to be selected. It can be noted that such a signal may already comprise or consist of a configuration signal enabling the selected lighting unit to be configured.

As mentioned above, the lighting units that need to be selected, need to be susceptible to the signal. In case the lighting units that need to be selected are provided with a sensor, e.g. a light sensor, providing a particular light signal to the sensor (e.g. having a particular intensity, color, duty cycle, etc. . . . ) can be recognized by the lighting unit as a selection command or a configuration signal. The selected lighting units may then be provided with a configuration signal which can e.g. be established using a user interface of a central control unit or a configuration tool. By selecting the lighting unit or units to be configured, one can establish that only the selected lighting units are susceptible to accepting a configuration signal. As only the selected lighting units are susceptible to accepting a configuration signal, the configuration signal can be provided to all lighting units, i.e. the configuration signal need not address the selected lighting units in particular. As such, by using a configuration tool including a mobile pointing device, a lighting grid which does not have a central control unit, can be configured easily without the need of individually addressing the lighting units with a configuration signal.

In general however, not all lighting units of a lighting grid are equipped with a sensor which can be used as an input for signals from a mobile pointing device. In order to configure one or more lighting units of such a lighting grid, a configuration method has been devised which does not require a lighting unit to be equipped with a sensor thus enabling the configuration of lighting grids that are less complex and thus less expensive.

In order to achieve this, the present invention provides several embodiments of a configuration method whereby the functionality of the lighting grid can be limited to:

- each lighting unit being capable of receiving control signals, and
- each lighting unit being capable of providing a controlled light output.

Depending on the configuration of the lighting grid, control signals for controlling a lighting unit can e.g. be provided by sensors available in the lighting grid, or a central control unit, or can be provided by other lighting units or a temporarily available configuration tool.

In order to configure a lighting grid, merely relying on the above given functionality, the following approach can be followed:

In a first step, a signal is provided to the lighting grid (e.g. by broadcasting an RF signal to the lighting units by a configuration tool) to operate the lighting grid in a configuration mode; Instructing the lighting grid (or a part thereof) to operate in a configuration mode can be established in various ways, e.g. depending on the communication facilities of the lighting units of the lighting grid.

As an example, the lighting units can be provided with a command to operate in the configuration mode by a mobile configuration device or a central control unit. Such a signal can e.g. be broadcasted using the communication means available (e.g. RF, DMX, power line, . . . ). As an alternative, or in addition, a mobile pointing device can be used for selecting a particular lighting unit and provide a command to operate in the configuration mode. Such a mobile pointing device can e.g. apply light as a communication means; the light being received by the lighting units. As yet another example, power cycling of one or more lighting units of the lighting grid can be used to trigger the one or more lighting units to operate in the configuration mode. In accordance with the present invention, power cycling is used to describe the operation whereby one or more lighting units are temporarily disconnected from the power supply, e.g. a mains power supply. Such a power cycling, e.g. disconnecting the lighting units (e.g. by operating a mains switch) followed (e.g. within a predetermined period, e.g. 1 or 2 seconds) by reconnecting the lighting units can result in the lighting units operating in the configuration mode. It is worth noting that a start-up towards a configuration mode may also be accomplished by a combination of the mentioned power cycling and a further input, e.g. from a switch or a sensor.

In an embodiment, the power cycling can be more complex and can be interpreted by the lighting units as a kind of code to operate in a particular mode.

As an example, disconnecting the lighting units followed by reconnecting the lighting units within one second (in general, a first period of time) can result in the lighting units operating in a first mode (e.g. a configuration mode) whereas disconnecting the lighting units followed by reconnecting the lighting units within a first period of time, followed by disconnecting the lighting units within a second period of time, and followed by reconnecting the lighting units within a third period of time, can resulting in the lighting units operating in a second mode (e.g. a learning mode, or a normal operating mode).

When operating in the configuration mode, the lighting units of the lighting grid can e.g. be arranged to generate a particular, unique light output. In order to, in a second step, select a particular lighting unit or units of the lighting units operating in the configuration mode, a mobile device is used for observing the unique light output of the particular lighting unit of interest. It is thus assumed that the configuration tool includes such a device which is capable of observing a particular lighting unit and generating a signal or data representing the unique light output of the lighting unit observed. In order to subsequently configure the particular lighting unit only, a configuration signal can be prepared for the particular lighting unit (e.g. using the configuration tool). The configuration signal can subsequently be broadcasted to the lighting grid together with the signal or data representing the unique light output. When the broadcasted signal is received by the lighting units, each lighting unit can assess whether or not to apply the configuration information, based upon the information representing the unique light output. A lighting unit should only apply the configuration signal in case the signal or data representing the unique light output which is broadcasted also represents the light output of the lighting unit. A lighting unit who's unique light output (when operating in a configuration mode) is not represented by the signal or data included with the configuration signal, should not apply the configuration signal. Once the appropriate lighting unit has applied the configuration signal (i.e. has been configured), it can e.g. stop operating in the configuration mode and can e.g. provide a visual indication that the configuration has been successful.

As will be understood by the skilled person, the procedure as described does not require the lighting units to be addressed individually based on an identifier of the lighting unit.

In order to control the lighting units of the lighting grid to operate in a configuration mode, the configuration method as applied can be preceded by a power cycling as described above or by a so-called discovery phase whereby a configuration tool or a central control unit is provided with data identifying the lighting units present in the grid. More details on such a discovery phase are provided below.

In an embodiment, the configuration mode can, as is explained further on, comprise operating the lighting units according to a so-called chase-method whereby the lighting units are arranged to sequentially provide a certain light output. Combined with the use of a mobile pointing device for observing the light output of a particular lighting unit, the different lighting unit of the lighting grid can be identified and selected in order to be configured.

With respect to the configuration methods according to the invention, it is worth noting that the different steps of the methods as described need not necessarily be performed in the order as presented above or as described in the claims.

In accordance with the present invention, the lighting grid (or a part thereof) can operate in a so-called learning mode. As already mentioned above, operating in such a learning mode may result in the lighting grid gathering information on the topology of the grid, which information can be used for configuring the lighting grid or units of the lighting grid. As an alternative, or in addition, the lighting grid or a part thereof can, during normal operation, be adapted to operate in a learning mode. In such learning mode, the lighting grid or one or more lighting units of the grid can gather information on the operation of the grid, process the information and, if required, adjust settings such as configuration data, of the grid. As such, in an embodiment, the lighting grid according to the invention can adjust its behavior based on an observed operation of the grid. As an example, it is assumed that a lighting unit has a default response upon a signal received from a sensor (e.g. an occupancy sensor). Such a response being the light unit providing an illumination of a specific color and intensity. If a user subsequently (e.g. within a specific period after the default response has started) adjusts the illumination parameters of the lighting unit (e.g. changing color and/or intensity), this event can be stored/memorized by the lighting unit. When this behavior repeats itself, this can be understood as the user wanting a different illumination characteristic compared to the default response. As such, in response to this, the default response of the lighting unit can be adjusted. In general, in an embodiment of the lighting grid according to the invention, a response of a lighting unit of the lighting grid can be adjusted on the basis of an observed behavior of a user of the grid. In the example given, assuming that the user each time reduces the intensity of the lighting unit to e.g. 50% (whereas the default value is 70%), the default value could be adjusted to the desired value (i.e. 50%) when such behavior is noted a number of times. In order to adjust the response of a lighting unit based on an observed operation of the grid, various options exist. As an example, when adjustments to an illumination parameter are noted and stored, an average value can be determined and applied as a default value for the illumination parameter. As a particular example, a moving average value of n adjustments can be applied.

When operating in such learning mode, the lighting unit or lighting grid may also take into account other factors apart from a user operating an interface. Such other factors may e.g. include feedback received from one or more sensors in the lighting grid or feedback from a clock indicating the time of day. Taking such factors into account enables a more accurate prediction to be made of the desired behavior of the lighting grid. Referring back to the example given, assuming it is e.g. noted that a user changes the color of the lighting unit to either warm white or cold white whereas the default value is an intermediate color temperature. Using only this input, an adjustment to the default value cannot easily be made as it is unclear how to change the default value. If however, it can be noted that the adjustment to cold white is made in the morning whereas the adjustment to warm white is made in the evening, the default value can be adjusted taking into account the time of day, resulting in a default response of the light unit which corresponds better to the response desired by a user. This learning can also extend to having lighting units ON or OFF at start-up, learning how the user switches lighting units ON/OFF during a period of time (f.e. a day). When switching on the lighting grid at a certain time of day, the most likely desired ON/OFF distribution at that time of day can be selected as the start-up situation, thus best satisfying the average user.

The following figures provide further details of embodiments of the present invention whereby corresponding reference numbers indicate corresponding features.

FIG. 1 schematically depicts a lighting unit according to the invention as can be applied in a lighting grid according to the invention.

Figure 2:
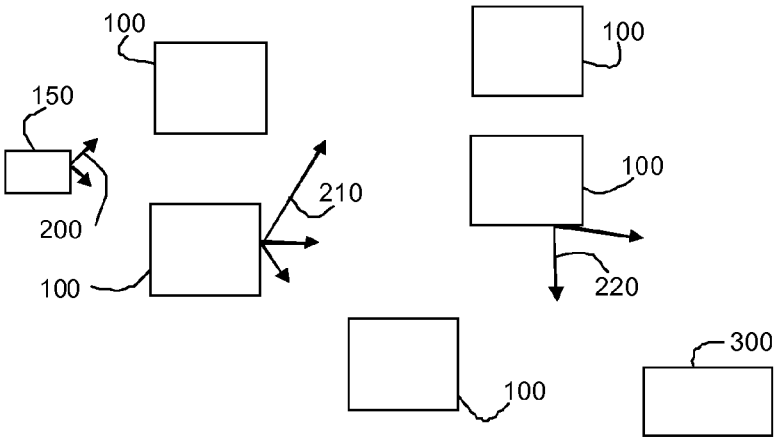

FIG. 2 schematically depicts an embodiment of a lighting grid according to the present invention.

Figure 3:
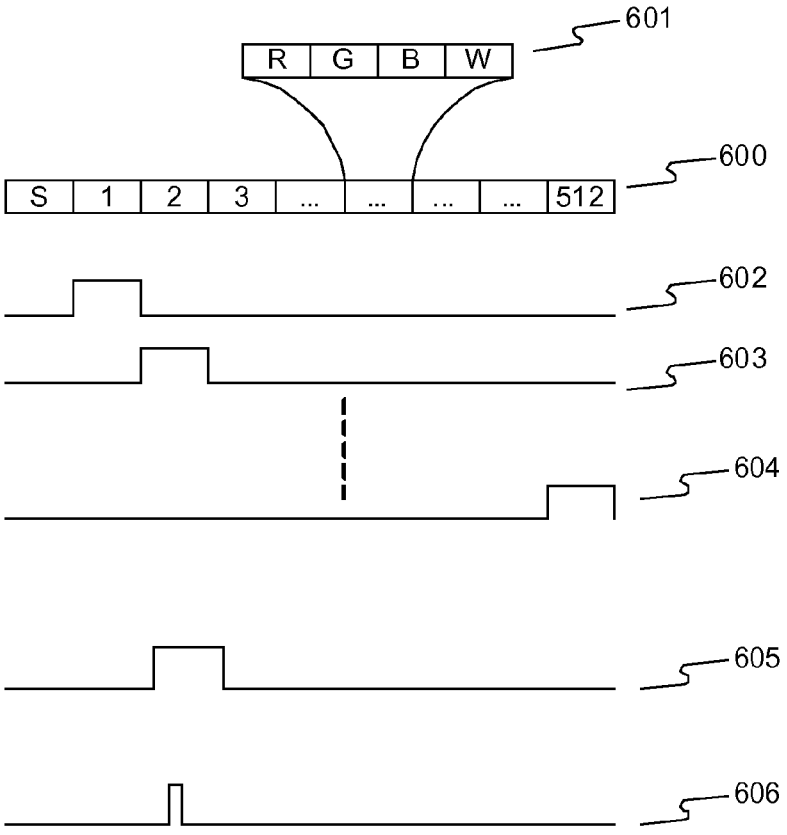
Figure 4:
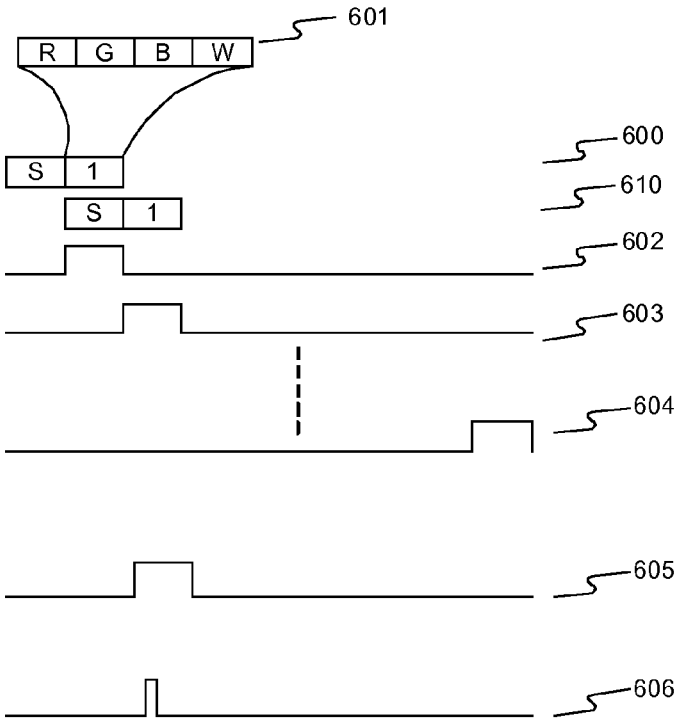
Figure 5:
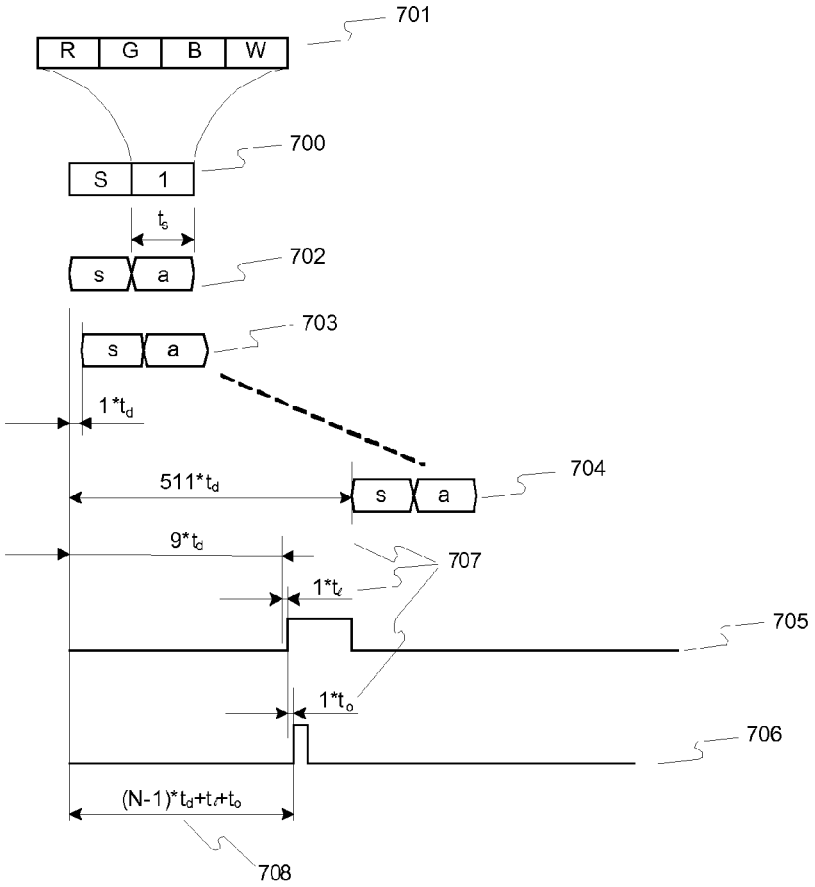

FIGS. 3-5 schematically depict series of information elements as can be applied in a chase for configuring a lighting grid.

Figure 6:
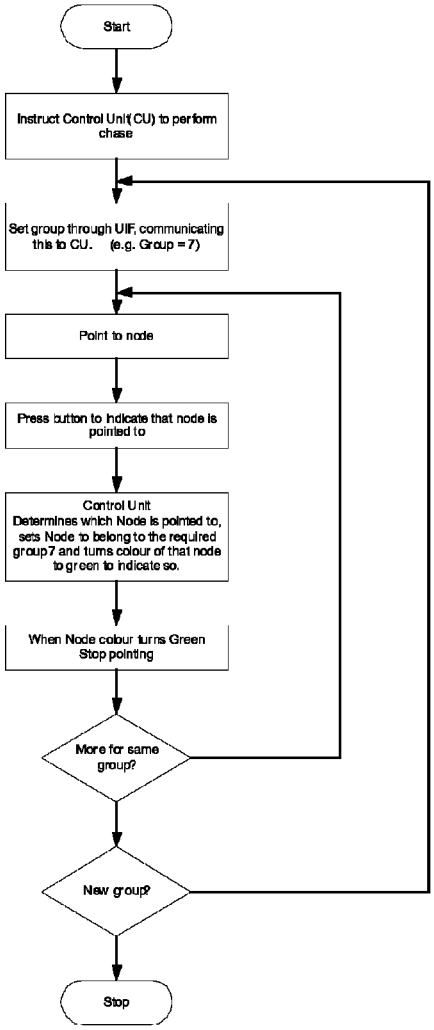

FIG. 6 schematically depicts a procedure for configuring a group of control units of a lighting grid according to the invention.

FIG. 1 schematically depicts an embodiment of a lighting unit 100 according to the invention, the lighting unit comprising an LED driver 110, an LED assembly 120 and a control unit 130 to either control the LED driver, the LED assembly or both, indicated by the arrows 140. The LED assembly 120 can e.g. comprise one or more LEDs. The LED driver for providing power to the LED assembly can e.g. comprise a Buck or Boost converter operating as a current source for powering the one or more LEDs of the LED assembly. The control unit 130, e.g. a microcontroller or processor, is arranged to

- receive, at an input, an input signal 145 from a sensor 150 indicating the occurrence of an event;
- determine a control signal 140 for controlling the LED driver and/or LED assembly based on the input signal and provide the control signal to the LED driver or LED assembly via a control output (not shown);
- determine an output signal 155 for transmission to one or more further lighting units, the output signal being based on the input signal and enabling an identification of the lighting unit;
- transmit the output signal 155 to the one or more further lighting units via a communication output of the control unit (not shown).

According to the invention, the control unit of the lighting unit is arranged to determine and transmit an output signal, the signal enabling a control unit receiving the signal to identify the lighting unit from which the signal originates.

In many cases, operating a lighting grid comprising a plurality of lighting units to realize a certain lighting effect can be established without providing each lighting unit with a dedicated command how to respond. In known lighting grids however, such an approach (i.e. applying a dedicated command for each lighting unit) is often applied. In such a known approach, a command signal is e.g. broadcasted to all lighting units whereby the signal e.g. comprises an array of set-points (e.g. describing a desired illumination level or colour), each set-point being preceded by an identifier or ID of the control unit for which the set-point is intended. As a result, each control unit is individually addressed by an identifier or ID in the command signal and is arranged to retrieve, from the command signal, the set-point associated with its ID.

In contrast, by applying a lighting unit or lighting grid according to the invention, it can be avoided to individually address each lighting unit. Instead of providing a command signal which comprises an array of set-points being preceded by an identifier or ID of the control unit for which the set-point is intended, the control unit of the lighting unit according to the invention transmits an output signal that enables an identification of the lighting unit from which the signal originates. As explained below, such identification can e.g. be based on an identifier of the control unit that transmitted the output signal comprised in the signal or can be based on the strength of the signal transmitted.

In an embodiment, a lighting unit according to the invention may then, upon receipt of a transmitted output signal from another lighting unit;

- establish an identification, based upon the received transmitted output signal, of the lighting unit that provided the transmitted signal; and
- determine a control signal for controlling the LED driver or LED assembly based on the identification.

Phrased differently, in accordance with the present invention, a control signal for controlling an LED driver or LED assembly of a lighting unit is determined on the basis of a received signal which enables an identification of the origin of the signal. The received signal can, in addition, e.g. comprise a certain illumination or color set-point. Whether or not to apply the set-point contained in the signal can e.g. be decided by the control unit based on the identification of the lighting unit that provided the signal. In order to assess how to respond to a received signal does require some intelligence to be available in the control unit to process the received signal. By doing so, the control units of the lighting units of the invention can autonomously process a received output signal and determine an appropriate control signal for the lighting unit. Optionally, the lighting unit or more specific, the control unit of the lighting unit can determine, based on the received signal, a further output signal and transmit it to one or more further lighting units, e.g. via a wired or wireless transmission the further output signal enabling an identification of the lighting unit.

When control units of lighting units are enabled to process input signals such as sensor signals, user interface signals or signals received from other control units and, optionally, provide output signals based upon the received signals, the operation of e.g. a lighting grid can be substantially facilitated. In particular, the complexity of the transmitted signals can be reduced as e.g. smaller signals can be applied.

In an embodiment, all control units can be programmed to respond in a similar manner to the signals received. In case an output signal is received from another control unit, the appropriate response of the control unit receiving the signal can be made dependent on a variety of parameters. By doing so, different illumination effects can be obtained. In a first example, the response of a control unit can e.g. depend on the identification of the control unit providing the signal, the identification being enabled by an identifier or ID being provided with the output signal. As such, a control unit can be programmed to provide a predetermined response when signals from certain other units are received. The control unit receiving the signal can e.g. be programmed to only respond to a signal (such a response can e.g. be to control the LED assembly associated with the control unit to provide a certain illumination) when the signal originates from a limited set of control units (identified via an identifier included in the signal).

In a second example, the control unit receiving a signal can base its response to the signal upon the signal strength. As an example, the control unit receiving the signal can e.g. be programmed to only respond to a signal (such a response can e.g. be to control the LED assembly associated with the control unit to provide a certain illumination) when the signal strength is above a certain value or within a certain bandwidth.

In order to obtain a certain illumination effect, a coordinated response of a plurality of lighting units of a lighting grid can be required. Such an illumination effect can be obtained by an appropriate programming of the control units of the lighting units. When programmed to respond in a certain way to a signal (e.g. based upon an identifier of the control unit or the signal strength of the transmitted signal) received from another lighting unit, certain desired visual effects can be obtained. In order to obtain the desired effect, use can be made of information regarding the lay-out or topology of the lighting grid. As an example, information regarding the relative position of the different lighting units of the lighting grid can be stored in memory unit of the control units of the lighting units of the grid or a central database accessible by the control units of the different lighting. Such information regarding the position of the different lighting units can be used by the different lighting units in order to establish a required response to a signal received. Such an arrangement may simplify the signal to be provided by the control unit broadcasting, in general, transmitting, the signal to the further lighting units.

FIG. 2 schematically depicts an embodiment of a lighting grid according to the invention. The lighting grid comprises a plurality of lighting units 100. One or more of the lighting units 100 is arranged to receive a signal 200 from a sensor or user interface 150. Based upon the input signal 200 received from the sensor or user interface, one or more of the lighting units 100 can, in response to the signal, determine a control signal for controlling a parameter, e.g. an illumination parameter such as an intensity or colour, of the lighting unit, determine an output signal 210 based on the input signal 200 and transmit the signal. The output signal being arranged such that a control unit of a (further) lighting unit receiving the signal can identify (e.g. based on the signal strength or an identifier comprised in the signal) the control unit or lighting unit from which the signal originates. Upon receipt of the signal, some or none of the lighting units 100 receiving the signal can determine a control signal for controlling a parameter, e.g. an illumination parameter such as an intensity or colour, of the lighting unit. In an embodiment, some of the lighting units can determine, based on the received output signal, a further output signal 220, based on the received output signal and transmit the signal. Said signal e.g. being received and processed by one or more further control units which can, in response, e.g. generate a yet further output signal etc. . .

The lighting grid as schematically depicted in FIG. 2 further comprises a database 300 which can e.g. comprise information regarding the topology or lay-out of the lighting grid (e.g. describing the relative positions of the lighting units) accessible by the lighting units. The information can e.g. be applied by the control units of the lighting units to determine, in combination with the identification of the origin of an output signal, an appropriate response (e.g. control signal for controlling the lighting unit) to such an output signal received.

In an embodiment, a subset of control units (i.e. a group of control units) can be programmed to respond in a similar manner to the signals received. In order to establish the group of control units to respond in a certain manner, the output signal provided by the control unit to the other control units may, apart from an identifier identifying the control unit transmitting the signal, also comprise a group identifier establishing which subset of control units should respond to the signal. Based upon the identifier of the control unit comprised in the control signal and the group identifier, the group of control units that form the subset can establish how to respond to the control signal, i.e. provide the appropriate response of the LED assembly such as a desired intensity or color.

As described above, a control unit of a lighting unit receiving an output signal from either another lighting unit or a sensor, can establish an appropriate response of the lighting unit based on the identification of the origin of the signal. In order to provide this response, the lighting units receiving a signal can be configured to respond in a certain way when a signal received is recognized. Preferably, a lighting unit or control unit of a lighting unit is configured in advance how to respond to control signals received. In addition, lighting units or control units of lighting units having a sensor associated with them, can be configured in advance to process a signal received from the sensor (e.g. a motion sensor or a brightness sensor) and transmit the signal in a certain format enabling another control unit or lighting unit receiving the signal to determine the origin of the signal and thus an appropriate response. The configuration of a lighting grid according to the invention or another lighting grid (e.g. controlled from a central computer or control unit) can be done by one or more configuration methods according to the present invention. Whether or not a particular method can be applied, may depend on the functionality available at the various lighting units. As will be understood by the skilled person, various ways of communication can be applied between the lighting units of a lighting grid and/or between the lighting units and sensors of the lighting grid. Furthermore, the sensors that can be applied in the lighting grid can be susceptible to different signals, e.g. they may respond to light, sound, motion or movement, etc. In some configurations, it may be possible to use a sensor associated with a lighting unit as a kind of interface to provide a configuration signal to the lighting unit, thereby configuring the lighting unit. Such a way of configuring may however require an extended functionality of either the sensor or the control unit receiving the sensor signal. As such an increased functionality requirement of either the sensors or the lighting units may add to the cost and/or complexity of the lighting grid, it is preferred to configure a lighting grid as much as possibly by using only the functionality required during normal operation of the grid. During normal operation, it is understood that the following functionality of the lighting grid is available:

- each lighting unit is capable of receiving control signals,
- each lighting unit is capable of providing a controlled light output.

The present invention provides different ways of configuring a lighting grid thereby only relying on the described functionality during normal operation. Within the meaning of the present invention, configuring a lighting grid is understood to provide instructions to the various lighting units whether or not and how to respond to a signal received from e.g. a sensor, a switch or another lighting unit. Such a configuration process or method can e.g. include steps that enable the identification of all components of the grid (i.e. the lighting units, sensors, switches, etc.), i.e. a so-called discovery phase, or establish the layout of the different components (e.g. the relative position of the lighting units) of the lighting grid.

In order to establish a required configuration, a configuration tool can be applied. Note that, in case the lighting grid is controlled by a central computer or control unit (as is often applied in known lighting grids), the functionality of the configuration tool can, at least partly, be implemented in the central computer. In an embodiment, a configuration tool can comprise a mobile device capable of receiving, 'capturing' a light output of a lighting unit of the lighting grid. In addition, the mobile device or another component of the configuration tool can be arranged to provide a control signal which can be received by one or more lighting units of the lighting grid.

In order to configure a lighting grid according to an embodiment of the present invention, the following steps can be performed:

In a first step, the configuration tool is arranged to provide a control signal to the lighting units to be configured such that the lighting units are operated in a configuration mode. The control signal can be provided to the lighting units using the same way of communication as applied during normal operation, e.g. RF, DMX, PLC, DALI, etc.

In an embodiment, the lighting units of the lighting grid (or a subset thereof) can be brought into the configuration mode using power cycling, i.e. disconnecting and reconnecting the lighting units from and to a power supply according to a predetermined pattern. Such switching can e.g. be established by operating a (mains) switch arranged in a supply circuit of the lighting units. Using power cycling to bring certain lighting units into the configuration mode enables a natural way of selecting lighting units or groups of lighting units which are often intended to operate in the same way. As an example, a group of lighting units arranged in a ceiling and operated from a common wall switch can easily be selected by power cycling the switch whereas broadcasting a control signal could result in additional lighting units switching to the configuration mode. In response to the control signal, each of the lighting units may then start to generate a unique light output. Such a unique light output can e.g. comprise a unique illumination set-point such as a color set-point or a duty cycle setting. Such a light output can be determined randomly by each lighting unit. By applying a sufficiently high resolution for randomly selecting the unique light output, it is highly unlikely that two lighting units would start to generate the same light output. When each lighting unit is operating at its unique light output, a mobile device is used to detect the light output of a lighting unit that is to be configured. Upon detection of the light output, the mobile device (further on also referred to as a pointing device or monitoring device) can assess the light output. To configure the selected lighting unit to be configured, the mobile device can then provide a configuration signal (e.g. to all lighting units using the same way of communication as applied during normal operation) whereby the configuration signal includes a signal describing the light output as detected. By including such a signal, the lighting units receiving the configuration signal can determine (based on a comparison of the light output as described and the light output as applied) whether or not to apply the configuration signal.

Upon receipt of the configuration signal, the lighting unit to be configured can e.g. store and/or process the configuration signal (e.g. in a memory unit of a control unit of the lighting unit) such that, during normal operation, the lighting unit can determine an appropriate response upon receipt of a control signal, based upon an identification of the origin of the control signal (e.g. the control signal originating from a sensor or another lighting unit). As such, the configuration signal can e.g. comprise data, e.g. a table, providing a relationship between one or more identifiers (e.g. IDs of sensors or control units) and a required response, i.e. a required light output. The configuration data can also comprise one or more group IDs to indicate that the lighting unit to be configured, is a member of the one or more groups indicated.

It can be noted that various options exist with respect to the content of the configuration signal, e.g. depending on the topology and desired characteristics of the lighting grid. In case the lighting grid is e.g. provided with a central database, this database can e.g. comprise a set of default or desired characteristics, each being provided with an identifier. As such, in order to configure a lighting unit, it may be sufficient to provide the corresponding identifier to the lighting unit in order for the lighting unit to know how to respond. Such an identifier can e.g. correspond to a group ID as mentioned above.

The configuration method as described enables the individual lighting units of a lighting grid to be configured without individually addressing, by means of a unique ID, the lighting units.

In order to control the lighting units of the lighting grid to operate in a configuration mode, the configuration method as applied can be preceded by a so-called discovery phase whereby a configuration tool or a central control unit is provided with data identifying the lighting units present in the grid.

As an example, such a discovery phase can be realized as follows in a lighting grid applying a central control unit which controls the lighting units of the lighting grid using DMX-communication. Note that other ways of communication can be applied as well and/or a configuration tool could be applied for the same purpose in case no central control unit is applied or required.

In the example, in a first step of the discovery phase, the lighting units of the lighting grid are arranged to, following a powering of the lighting units, transmit a unique ID (UID) via the DMX-network. It is further assumed that this unique ID is re-transmitted after a random period of time, when the lighting unit does not receive, from the central control unit, a command to stop transmitting the unique ID. The transmission of the unique IDs may cause some collisions on the network but, eventually, due to the fact that the unique IDs are not transmitted in a synchronized way but actually in a randomly distributed manner, the central control unit will receive a UID from a lighting unit. Upon receipt of such a UID, the central control unit can store the UID and provide a command to the lighting unit having the lighting unit with the UID to stop transmitting. This process is repeated until no UIDs are transmitted at which point all lighting units have been identified and their UIDs have been stored.

Once such a discovery phase has been executed, the central control unit can, using the DMX network, control the lighting units to operate in a configuration mode. Such a configuration mode can, as is explained further on, comprise operating the lighting units according to a so-called chase-method whereby the lighting units are arranged to sequentially provide a certain light output.

Such a chase-method can be applied to e.g. individually configure each of the lighting units and/or it can be applied to determine a lay-out of the lighting grid which can subsequently be applied by a central control unit or configuration tool, to, at least partly, configure the lighting grid. When a lay-out of the lighting grid is determined, this may facility defining groups of lighting units (e.g. LED units) of the lighting grid. Defining one or more groups within a lighting grid can be applied to facilitate the control of the lighting grid and can thus be considered as an optional step in any configuration method.

In order to configure a lighting grid such that it can be controlled using one or more group IDs, different methods for defining groups of LED units in a lighting grid, can be applied.

As first example, a group ID can be assigned to each control unit by a central computer, e.g. based on the lighting unit address and position. By doing so, different subset of lighting units of the lighting grid can be provided with a group ID in order for the group to be addressed easily from a control unit transmitting an output signal, e.g. in response to a received sensor signal.

As a second example, an interface can be applied to transmit a group ID to selected lighting units in order to establish a subset of lighting units of a lighting grid. Such a selection and configuration of different lighting units forming a subset can e.g. be done as follows: In a first step, the lighting units are brought into an operating mode for configuration. This can e.g. be done by broadcasting a dedicated signal to all lighting units by one of the lighting units or e.g. a mobile device.

In a next step, each lighting unit that needs to be included in a group can then be selected, e.g. by walking around through the lighting grid and by pointing with a light beam (e.g. using a mobile device) to the selected units thereby e.g. enabling a group ID (e.g. comprised in the dedicated signal) to be stored in the selected lighting unit. Such an arrangement assumes each lighting unit that needs to be included in the group to be able to receive (e.g. via a communication terminal or input terminal) a signal. In case the lighting units are provided with an input for receiving a signal from a sensor, the configuration can be established by providing a dedicated signal to the sensor.

As a third example, a lighting grid can e.g. be configured using a so-called chase-method. In order to explain the method, reference is made to FIG. 3 depicting how the selection of a lighting unit (or control unit of a lighting unit) can be made. FIG. 3 is based on the lighting grid topology as shown in FIG. 2 further assuming the sensor or user interface 150 being arranged to detect light that is radiated by the LED assemblies of the lighting units (as an alternative, a dedicated monitoring sensor may also be applied for this purpose) and wherein a control unit of at least one of the lighting units is arranged to send an illumination set point to the other units and wherein the control units are capable of holding configuration settings in a local memory or setting configuration settings in a selected lighting unit. As an alternative, a central control unit or configuration tool capable of sending an illumination set point to the lighting units of the lighting grid, can be assumed. In FIG. 3, element 601 then represents a series of information elements sent to the lighting units in the lighting grid in a broadcasted manner by the control unit (that is, all nodes receive all information elements. In this case a DMX-like network is assumed, with nodes reacting to the information element that corresponds to the position of the node in the network). 602 represents the light given by lighting unit 1 caused by a non-zero set-point in information element 1. Likewise, 603 represents the radiation of light from lighting unit 2 because of a non-zero set-point in information element 2. Continuing this scheme will finally deliver graph 604 indicating lighting unit 512 to radiate light. The light can then, as mentioned above, be detected by a sensor associated with the lighting unit radiating the light or by a dedicated monitoring sensor. Such a monitoring sensor can be made directional to avoid light from neighboring units to disturb this detection. The detection of the light of the unit is depicted by graph 605. The knowledge that light is detected can then be sent, e.g. via wireless communication, to the control unit, that provided the illumination set point. The control unit will check during the sending of each information element whether or not the monitoring sensor detects light as is indicated by 606. From the fact that the control unit (or central control unit or configuration tool) knows which information element it is sending at the moment it is informed that the monitoring sensor is detecting light, it can conclude the correspondence of the information element to the physical location, or it can set configuration data, pre-set from the monitoring sensor before starting the chase operation, for that information element in local memory (such as a group identifier). Phrased differently, by matching the timing of the light output observed by the monitoring sensor with the controlled light output as provided by the chase, a particular lighting unit of the lighting grid can be selected and subsequently configured. As such, a selection of a lighting unit of the lighting grid to be configured can be realized by observing the light output of the lighting unit to be selected and identifying the lighting unit from the observation and the chase.

As an alternative to sending a separate information element for each lighting unit, one single element of information can be sent by a first control unit, which is then forwarded by each control unit to a next control unit with a certain delay. FIG. 4 schematically illustrates this principle. In FIG. 4, 610 represents the delayed information element as it leaves the first control unit and is received by the second control unit. In this case the delay is depicted as exactly the transmission time of 1 information element, but this can be varied. This is repeated per control unit (not depicted), thus practically implementing a broadcast. Assigning a group ID to one or more of the control units can be realized in substantially the same way as illustrated in FIG. 3. When using shorter delays, the situation as discussed with respect to FIG. 5 can become valid. In FIG. 5, an alternative chase-method, based on the delay of communicating the broadcasted data from control unit to control unit (f.e. in a DMX-like network), is depicted. In FIG. 5, 700 depicts the data package of information elements with an ordering number as they are sent by a control unit. 701 depicts as an example the set-point for the Red, Green, Blue and White LEDs or colors of the control unit the information element is meant for. 702 depicts the data package as sent by the control unit again, this time having marked the information elements with letter 'a' to refer to the value or contents of the information element. 703 depicts the data package as it leaves control unit 1 and is received by control unit 2, i.e. delayed by 1*td. In a DMX-like network such a delay is common. 704 depicts the data package as it leaves control unit 511 and is received by control unit 512. Assume the $10^{th}$ control unit being of interest and that 705 shows the period the LED assembly associated with the $10^{th}$ control unit is radiating light. 706 then shows the detection of light by a monitoring sensor when it is pointed to the $10^{th}$ control unit. 700 identifies the delay times that are occurring. $t_d$ is the delay time incurred by a control unit when forwarding the data package to the next control unit. $t_l$ is the delay time before a control unit radiates light after having received the information element. $t_o$ is the delay time before the monitoring sensor has detected the light from the control unit. When this detection signal 706 is sent to e.g. a central control unit (for example using a wireless transmission), the central control unit can work out which control unit the monitor sensor is pointing to from time-stamping the leading edge of the detection signal and applying formula 708 to calculate N. The central control unit needs to know the times $t_d$, $t_l$ and $t_o$ beforehand to perform the calculation.

In FIG. 6, a procedure for group assignment related to a chase method as described above is given. For anyone skilled in the art it will be appreciated that other settings than group membership and other procedure orders can be applied to achieve other parameters (such as color) to be set. The latter example would enable the color to be set on a per control unit basis, while the brightness could be set centrally from a central control unit. In FIG. 6, the term "node" refers to a lighting unit.

It is worth noting that, as will be understood by the skilled person, the chase-methods as explained can also be applied to individually configure a selected lighting unit rather than merely assigning one or more group IDs to the lighting unit selected.

Alternatively, or in addition, a chase method can be applied to determine the lay-out of a lighting grid, e.g. a rectangular lighting grid having n rows and m columns for illuminating a comparatively large area such as a parking area. It is further assumed that a discovery phase, as e.g. described above, has been performed such that a central control unit or a configuration tool is provided with an identification of the lighting units in the grid. When the lighting units are thus operated according to a chase method as described above, e.g. by providing each of the lighting units, based on the UID of the units with a set-point, the lighting units may sequentially, for a brief instance, provide a certain light output. In general, the sequence at which the lighting units provide the light output will be in an arbitrary pattern. Establishing the relative position of each lighting unit within the grid (which can be considered an example of determining the lay-out of the grid) can then be realized as follows. When using a directional monitoring sensor as indicated above, the observance of a light output from the monitored lighting unit can be communicated by the monitoring device to the central control unit or configuration tool (as e.g. indicated by graph 606 of FIG. 3. Instead of merely indicating the observance of the light output, the monitoring device can be arranged to communicate, when a light output is observed of a particular lighting unit, positional information about the monitored lighting unit to the central control unit or configuration tool. The information as provided can e.g. comprise physical co-ordinates of the position of the lighting unit or could merely indicate, in case of the rectangular grid, the relative position of the lighting unit, e.g. as (x,y) co-ordinates. By repeating this process, the lay-out of the lighting grid can be made available to the central control unit or configuration tool.

Such information can e.g. be applied by the central control unit or configuration tool to provide a graphical representation of the lighting grid. When such a graphical representation of the lighting grid is available, defining groups can be facilitated by application of a graphical user interface that e.g. enables the lay-out of the lighting grid to be displayed and enables lighting units to be selected based on the displayed lay-out. When a group is defined or selected, a group ID can subsequently be assigned to the required lighting units in various manners, depending on the functionality available.

In an embodiment, the lay-out of a lighting grid can be established in an automated manner using a chase. As mentioned above, when (e.g. as a result of a discovery phase) each lighting unit in a lighting grid is identified, a so-called chase can be initiated whereby each lighting unit is e.g. sequentially operated for a certain period of time. During the chase, when a lighting unit is operated, the other lighting units are assumed to observe and detect any change in ambient light received. Based on the observed change in ambient light received, an estimate of the relative positions of the different lighting units in the grid can be established. As such, an estimate of the lay-out of the lighting grid can be obtained. Phrased differently, by the described chase procedure, each lighting unit can obtain its relative position with respect to the other lighting units in the grid. Based on the information thus obtained, certain lighting effects can be realized. As an example, when an occupancy sensor associated with a lighting unit detects movement, the associated lighting unit can be operated. Based on the lay-out information, neighboring lighting units may be operated as well, e.g. at a reduced intensity. As such, an area surrounding the person that triggered the occupancy sensor can be lit. As an example, applying the lay-out information enables part of a corridor in front of a person and part of the corridor behind the person to be lit by lighting units in front and behind the person moving through the corridor. Note that in order to achieve this effect, only little information needs to be exchanged; it is sufficient that a lighting unit associated with an occupancy sensor provides a signal that enables the other lighting units to identify the transmitting lighting unit. The identification combined with the lay-out information provides sufficient information for the other lighting units to determine if and to what extent, illumination should be provided.

It is worth noting that the use of a chase as described can be considered an example of the lighting grid operating in a learning mode. As another example, the lighting grid according to the invention can adjust its behavior based on an observed operation of the grid when operating in a learning mode. In such case, the learning mode is active during the normal operation of the lighting grid. The learning mode enables a response to a signal received (e.g. from an occupancy sensor) to be altered, based on e.g. user actions occurring subsequently. As an example, it is assumed that a lighting unit has a default response upon a signal received from a sensor (e.g. an occupancy sensor). Such a response being the light unit providing an illumination of a specific color and intensity. If a user subsequently (e.g. within a specific period after the default response has started) adjusts the illumination parameters of the lighting unit (e.g. changing color and/or intensity), this event can be stored/memorized by the lighting unit. When this behavior repeats itself, this can be understood as the user wanting a different illumination characteristic compared to the default response. As such, in response to this, the default response of the lighting unit can be adjusted. In order to adjust the response, a (statistical) analysis of the user behavior can be made such as taking the average of the adjustments made, or the moving average of the latest n adjustments. Further, the adjustment of the response may also be based on other factors/parameters, apart from the user action/behavior. As an example, the time of day or feedback from ambient or other sensors can be used to find a correlation between the user operation of a user interface and the desired illumination parameters When the lay-out of the lighting grid is known, this may also facilitate a group ID assignment in the following manner: assuming again a rectangular n by m grid whereby the co-ordinates are known to a central control unit or configuration tool. In order to define a group comprising a certain row or part of a row, it may be sufficient to select only one member of the row or the start- and endpoint of the row part. Such a selection can e.g. be made using the configuration method as described above. In case the lighting units of the lighting grid have a sensor associated with them, a selection of e.g. the start- and endpoint of a row can be made by providing a signal to the sensor, e.g. directing a light beam to the sensor.

In order to facilitate the configuration and to ensure that the configuration is performed appropriately, the lighting units can be arranged to provide a certain light output in response to a certain configuration step being executed thereby acknowledging this step to being performed.

In order to configure one or more lighting units of a lighting grid, assuming that the lay-out or graphical information about the grid (such as x,y-location) is known, a user can e.g. indicate, via a user interface of the configuration tool, which lighting unit to configure, subsequently point at the selected lighting unit using a pointing device, thus enabling the lighting unit pointed at to receive a configuration signal and thus becoming configured.

When subsets of lighting units of a lighting grid are defined and the lighting grid is configured accordingly (i.e. by providing the control unit of each lighting unit of the lighting grid with the appropriate group ID or IDs (note that a lighting unit can be a member of more than one subset of lighting units), the lighting grid according to the invention can easily be applied to perform one or more of the following functions.

As a first example, the intensity or colour of a subset of lighting units of the lighting grid (e.g. identified by a group ID that is provided to a memory unit of the control unit of each lighting unit of the subset) can be adjusted in response to an ambient light sensor feedback. Assuming an ambient light sensor being associated with a lighting unit of the lighting grid such that a signal of the ambient light sensor can be received by a control unit of the lighting unit (note that the lighting unit need not be part of the subset), the control unit can e.g. broadcast a control signal comprising an identifier of the control unit, a group ID and a signal related to the sensor signal. Upon receipt of the control signal, the further lighting units of the lighting grid can determine whether or not to respond to the signal (e.g. based upon the identifier of the control unit and the group ID) and how to respond (e.g. adjust an intensity or colour based upon the signal related to the sensor signal).

As a second example, a combined use of group IDs and sensors such as occupancy sensors or ambient light sensors can be applied to ensure appropriate illumination in a room where the presence of a window results in a non-uniform illumination. In case the room is provided with a plurality of lighting units, In order to provide a uniform illumination, one could allow each lighting unit to provide a particular contribution, based on the ambient conditions occurring on the position of the lighting unit. In some cases, this may be undesired. As an example, in case the lighting units are grouped in rows, it may be desired that each lighting unit of a certain row applies the same illumination, for visual esthetic reasons. In such case, the use of group IDs can be beneficial to ensure that each member of a group operates in the same manner. In an embodiment, the each defined group could apply an average of their ambient sensor values.

Similarly, as a third example, a subset of lighting units of a lighting grid can be activated upon receipt of a signal from an occupancy sensor associated with a lighting fixture. By applying a plurality of occupancy sensors and defining different subsets of lighting units, one can ensure, as illustrated below, that lighting conditions are easily adjusted to the occurrence of different events.

The application of a group ID in combination with an identifier of a control unit transmitting a signal (e.g. by broadcast) can equally be applied in case of an emergency (e.g. a smoke detector transmitting a signal to one or more control units whereupon the control unit broadcasts a signal in response. The lighting units that are member of the subset having the group ID may then, in response to the received signal, provide an appropriate response, i.e. provide a predetermined illumination characteristic.

The lighting grid according to the present invention may advantageously be applied for providing an appropriate illumination to a comparatively large area. As an example, a lighting grid according to the present invention can be applied to illuminate part of a corridor depending on events occurring in or near the corridor. The lighting grid according to the invention has the ability of detecting an event and to operate the lighting units of the lighting grid based on the event or events occurring.

Assuming a corridor in a large hotel, the corridor being provided with a plurality of lighting units. To save energy, the lighting units are typically out when no one is in the corridor. When a guest (or any other person) leaves his room and enters the corridor, a first event occurs. This event can e.g. be detected by a sensor of the lighting grid (e.g. a motion sensor or proximity sensor). When the event is detected by the sensor, the sensor can provide a signal to one or more lighting units of the grid. The sensor can e.g. be associated with one or more of the lighting units of the lighting grid by means of a communication interface, or can be incorporated in one of the lighting units of the grid or can be arranged to, when the first event occurs, broadcast a signal, one or more of the lighting units being configured to receive and respond to the signal. In accordance with the present invention, the sensor signal is received by one or more of the lighting units and applied by the control unit of the lighting unit to generate a control signal for controlling the LED driver or LED assembly in accordance with the sensor signal. In response to the receipt of the sensor signal, the control unit may further provide a signal to one or more further lighting units. The further lighting units receiving the signal may then, in response to the signal provide an appropriate illumination. As indicated above, the signal that is e.g. broadcasted can comprise a group ID such that only those lighting units having the broadcasted group ID respond to the signal. As a result, the required lighting conditions can be provided in the vicinity of the guest e.g. 5-10 meters in each direction of the corridor.

When subsequently, the guest starts moving through the corridor, a second event occurs which can e.g. be detected by another sensor of the lighting grid, for example through a motion sensor. Upon receipt of a signal from the sensor, one or more lighting units (or a predetermined subset of lighting units grouped by a group ID) can be turned on, either in response to the sensor signal received or in response to a signal received from a lighting unit. Further, one or more lighting units can be turned off again, as they are too far away from the guest or not in his moving direction.

When subsequently, the guest leaves the corridor altogether this can equally be detected, e.g. through a motion sensor. As a result, when no other persons are in the corridor, all lighting units in the corridor are switched off again. There may be some time delay to consider the situation that the guest (or any other person) may return very quickly due to f.i. having forgotten something.

In an embodiment, a lighting grid according to the invention can be used to illuminate a corridor, whereby the lighting grid comprises an array of light units arranged along the corridor whereby only a lighting unit at the beginning of the corridor and a lighting unit at the end of the corridor are provided with an occupancy sensor. When either sensor detects the presence of a guest, a lighting unit associated with this sensor can respond by adjusting its illumination and provide a signal to the further lighting units of the grid for adjusting the illumination.

As illustrated, the various aspects of the present invention (either the method of operating a lighting grid, the lighting units or the lighting grid according to the invention) enable a more compact way of communication between various lighting units of a lighting grid. Transmitted signals by the lighting units or other units can be simplified as they do not need to individually address the lighting units of the lighting grid that need to respond to the signal.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The invention claimed is:

1. A method of operating a lighting grid comprising a plurality of lighting units, the method comprising the steps of:

receiving an input signal from a sensor or a user interface by one first lighting unit of the lighting grid;

determining a control signal for controlling an LED driver and/or LED assembly of the first lighting unit based on the input signal;

transmitting an output signal to a second lighting unit of the lighting grid, the output signal being based on the input signal and enabling an identification of the first lighting unit, the sensor or the user interface;

receiving the transmitted output signal from the first lighting unit by the second lighting unit;

establishing an identification, based upon the received output signal, of the first lighting unit, the sensor or the user interface, wherein the identification is established based on a signal strength of the received output signal;

determining a further control signal for controlling an LED driver and/or LED assembly of the second lighting unit based on the output signal and the identification.

2. The method according to claim 1 wherein the transmitted output signal further comprises a group identifier.

3. The method according to claim 1 wherein the identification is established based on an identifier of the first lighting unit comprised in the received output signal.

4. A lighting unit for use in a lighting grid, the lighting unit comprising an LED assembly comprising one or more LEDs;

an LED driver, electrically connected to the LED assembly for providing power to the LED assembly;

a control unit comprising:

a communication input for receiving a transmitted output signal from one or more further lighting units;

a control output for providing a control signal to the LED driver and/or the LED assembly for controlling the LED driver and/or the LED assembly based on the output signal and an identification of the one or more further lighting units;

the control unit being arranged to establish the identification of the one or more further lighting units, based upon a signal strength of the received output signal from the lighting unit, requiring a received output signal from only one of the further lighting units.

5. A lighting unit for use in a lighting grid, the lighting unit comprising an LED assembly comprising one or more LEDs;

an LED driver, electrically connected to the LED assembly for providing power to the LED assembly;

a control unit comprising:

an input for receiving an input signal from a sensor or a user interface;

a control output for providing a control signal to the LED driver and/or the LED assembly for controlling the LED driver and/or the LED assembly, the control signal being based on the input signal;

a communication output for transmitting an output signal to one or more further lighting units, the output signal being based on the input signal and enabling an identification of the lighting unit, the output signal having a predetermined signal strength, enabling an identification of the lighting unit based upon a received signal strength, the enabling requiring only the output signal from the lighting unit.

6. The lighting unit according to claim 5 wherein the control unit is further arranged to receive a transmitted output signal from one or more further lighting units;

establish an identification, based upon the received output signal, of the one or more further lighting units that provided the transmitted output signal;

determine a further control signal for controlling the LED driver or LED assembly based on the output signal and the identification.

7. A lighting grid comprising one or more lighting units according to claim 5 and further comprising a further lighting unit comprising:

an LED assembly comprising one or more LEDs;

an LED driver for providing power to the LED assembly;

a control unit arranged to a. receive the output signal transmitted by the control unit of the lighting unit;

b. establish an identification of the lighting unit that transmitted the output signal, based upon the signal strength of the received output signal; and c. determine a further control signal for controlling the LED driver or LED assembly of the further lighting unit based on the output signal and the identification.

8. The lighting unit according to claim 6 wherein the transmitted output signal comprises an identifier enabling the control unit receiving the transmitted output signal to identify the lighting unit that transmitted the output signal.

9. The lighting unit according to claim 6 wherein the control unit receiving the transmitted output signal is arranged to identify the lighting unit that transmitted the output signal based on a signal strength of the received output signal.

10. The lighting unit according to claim 6 wherein the transmitted output signal further comprises a group identifier.

11. The lighting unit according to claim 5 further comprising a sensor or user interface for providing the input signal.

12. The lighting unit according to claim 5, wherein the control unit is arranged to operate in a learning mode, thereby storing a plurality of input signals received over time from a user interface;

analyzing the plurality of input signals;

determining an amended control signal for controlling the LED driver and/or the LED assembly based on the analysis;

providing the amended control signal at the control output of the control unit.

13. The lighting unit according to claim 12 wherein the step of analyzing comprises determining an average or moving average of the plurality of input signals.

14. The lighting unit according to claim 12 wherein the analysis is further based on a sensor signal such as an ambient sensor signal or an occupancy sensor signal.

15. The lighting unit according to claim 12, wherein the analysis is further based on further circumstances such as time of day.

16. A lighting grid comprising a plurality of lighting units according to claim 5.

17. The lighting grid according to claim 16 further comprising a database accessible by the control units of the lighting units of the lighting grid, the database comprising information regarding the topology of the grid.

18. The lighting grid according to claim 17 wherein the control units of the lighting units are arranged to determine the control signal or further control signal based on the information regarding the topology of the grid.

19. The lighting grid according to claim 17 wherein the database is provided in a memory unit of lighting units.

* * * * *